US005482288A

United States Patent [19]

Cedeno

[11] Patent Number: 5,482,288

[45] Date of Patent: Jan. 9, 1996

[54] RACE-TO-THE-FINISH BOARD GAME WITH OBSTACLES

[75] Inventor: Isacc Cedeno, Bayamen, Puerto Rico

[73] Assignee: Commonwealth of Puerto Rico, San Juan, Puerto Rico

[21] Appl. No.: 331,901

[22] Filed: Oct. 31, 1994

[51] Int. Cl.[6] ..... A63F 3/00

[52] U.S. Cl. ..... 273/249

[58] Field of Search ..... 273/242, 243, 273/248, 249, 251, 252, 254

[56] References Cited

U.S. PATENT DOCUMENTS

| | | | |
|---|---|---|---|
| 1,517,847 | 12/1924 | Llera et al. . | |
| 1,695,144 | 12/1928 | Edwards . | |
| 1,707,323 | 4/1929 | Schaffer . | |
| 4,323,249 | 4/1982 | Brady | 273/249 |
| 4,714,255 | 12/1987 | Henry et al. | 273/249 |
| 4,787,639 | 11/1988 | Ross | 273/249 |
| 4,889,345 | 12/1989 | Wawryk | 273/249 |
| 5,052,692 | 10/1991 | Gustafson | 273/249 |
| 5,071,134 | 12/1991 | Burroughs | 273/249 |
| 5,139,268 | 8/1992 | Garnett . | |
| 5,143,378 | 9/1992 | Joel | 273/243 |
| 5,350,179 | 9/1994 | Hill et al. | 273/249 |

*Primary Examiner*—William E. Stoll

*Attorney, Agent, or Firm*—Oblon, Spivak, McClelland, Maier & Neustadt

[57] ABSTRACT

A board game having a plurality of stations intermediate start and finish stations. Some of the intermediate stations bearing obstacle directions which include events calling for the presence of public servants. A player has two identical tokens one representing himself and the other a public servant. When the first token lands on one of the designated event stations it must remain there until the appropriate public servant reaches that station from stations designating public building appropriate to that public servant and that event served thereby. There is also an exterminating zone which can result in a player being expelled from the game.

5 Claims, 5 Drawing Sheets

FIG. 5
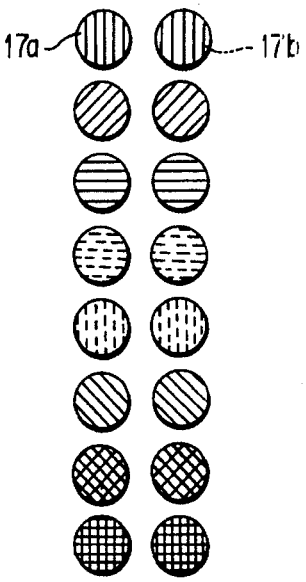
FIG. 2
| | |
|---|---|
| 1b | 1c |
| 1a | 1d |
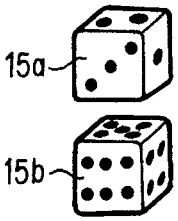
FIG. 3
FIG. 4
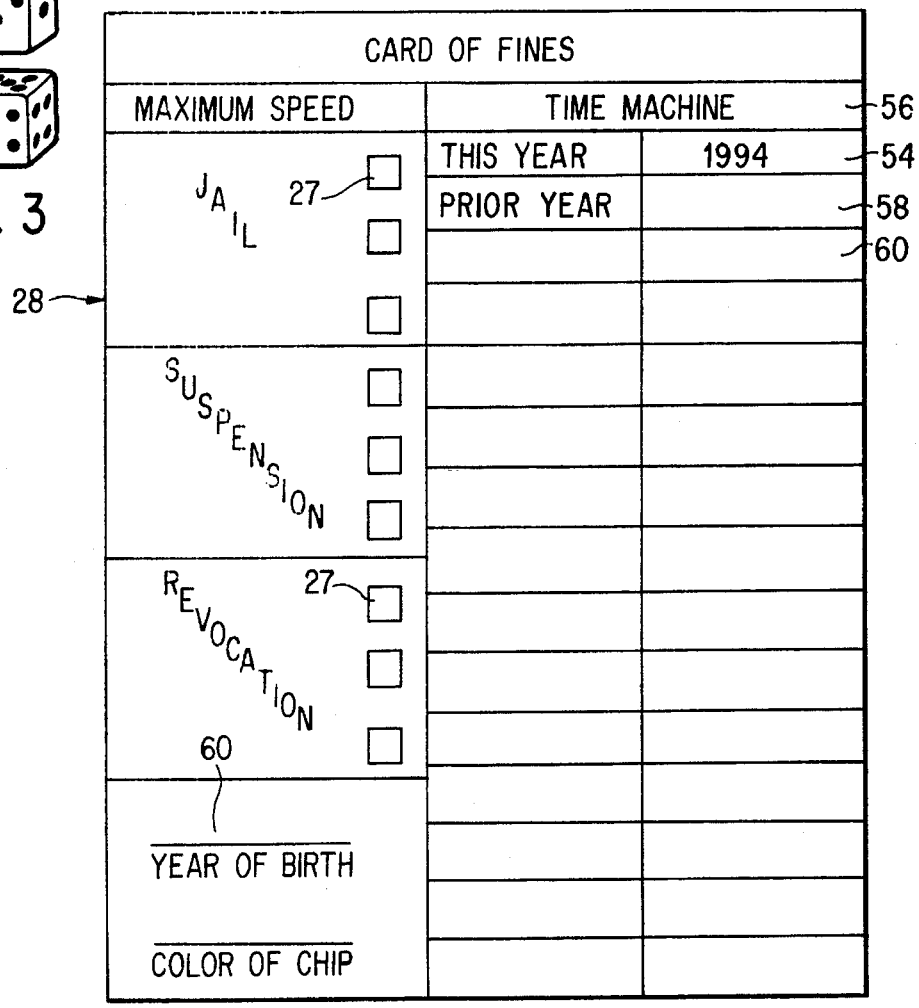

RACE-TO-THE-FINISH BOARD GAME WITH OBSTACLES

FIELD OF THE INVENTION

This invention relates to board games and more particularly to a race-to-the-finish board game with obstacles.

BACKGROUND OF THE INVENTION

Race-to-the-finish board games are well known. In common with them all is a path divided into intermediate stations between start and finish stations, some of the intermediate stations bearing labels defining some sort of obstacle which prevents a player from moving unimpeded from the start to finish stations. Presenting interesting obstacles which are different from usual obstacles yet can be understood by players of every age from first graders to adults is a challenge to board game designers and it is the object of the present invention to provide an improved board game which presents new and challenging but easily understood obstacles.

BRIEF DESCRIPTION OF THE INVENTION

The board game of the invention is similar in many respects to other race-to-the-finish with obstacles type board games. The game includes a path divided into stations some bearing obstacle labels which must be obeyed, some bearing public building labels, and some bearing special labels which call for the presence of public servants which are dispatched from appropriate public buildings. Each player is provided with a set of two identical tokens, each set being different from every other set. When a player's token lands on a station, bearing one of the special labels, the token must remain there until the other token of the player's set, now representing a public servant relevant to the special label, is moved for each of the player's subsequent turns from a relevant public building to the special label station, e.g. a policeman from a police station to an auto accident, etc.

Adding further unusual interest to the game is a station labeled "Time Machine" with the succeeding stations on the path being numbered from 1 to 6 and labelled collectively "Exterminating Zone". Whenever a player lands on the Time Machine station he then throws a single die and moves to that station of the six whose number corresponds to that on the single die. He also subtracts that number from the present year and if the resulting year is earlier than the year of the player's birth he must withdraw from the game on the grounds that he doesn't exist. Though the first occurrence will seldom have this result, it is possible for a player to be sent back several times to the downstream side of the Time Machine station and thus he may land on the latter several times, each time substracting progressively from the year last arrived at, a number 1 to 6, with the accumulated total possibly taking a player back before the year of his birth, resulting in his expulsion from the game.

The invention will be better understood when read in conjunction with the accompanying drawings wherein:

BRIEF DESCRIPTION OF THE DRAWINGS

FIG. 2 is a view on a reduced scale showing the manner in which the quarters 1*a*–1*d* of the board interfit;

FIG. 3 is a perspective view of a pair of dice employed with the game of the invention;

FIG. 4 a plan view of a card entitled "Card of Fines" which is issued to each players; and FIG. 5 is a plan view of sets of token pairs, each set being differently colored, which are issued to each player.

DETAILED DESCRIPTION OF THE INVENTION

Figure 1A:
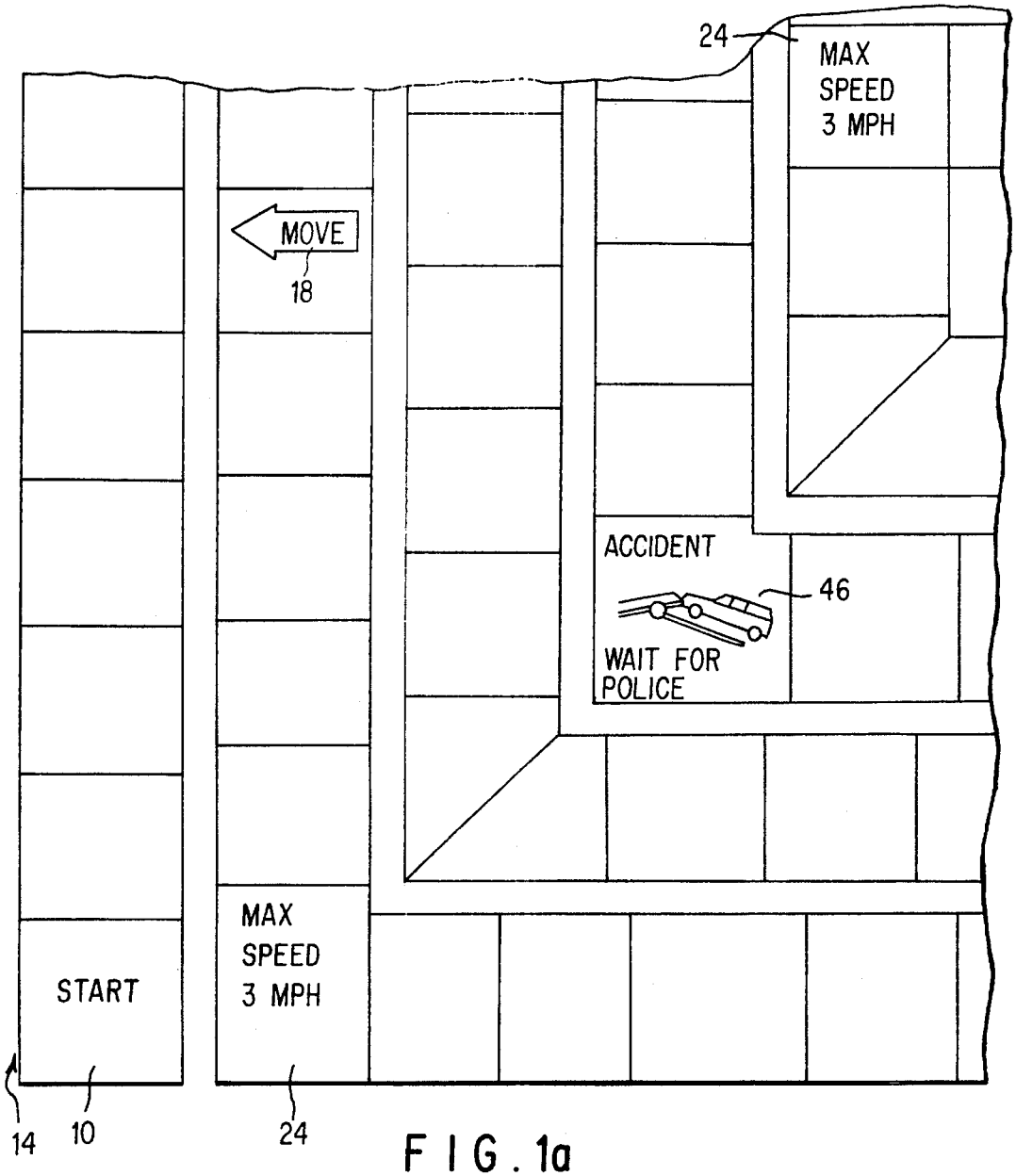
FIGS. 1*a* through 1*d* are plan views of the entire board divided into substantial quarters.
Figure 1B:
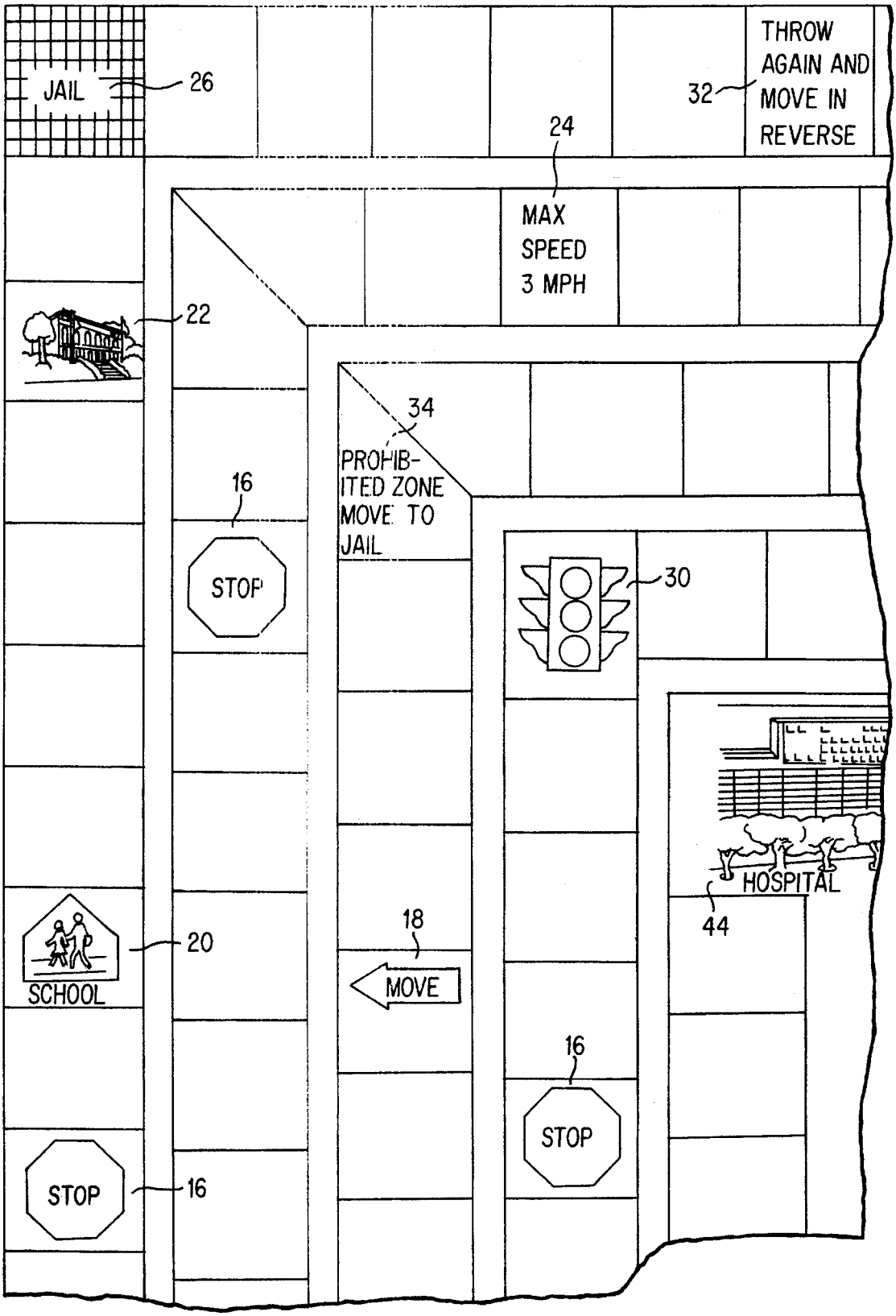
Figure 1C:
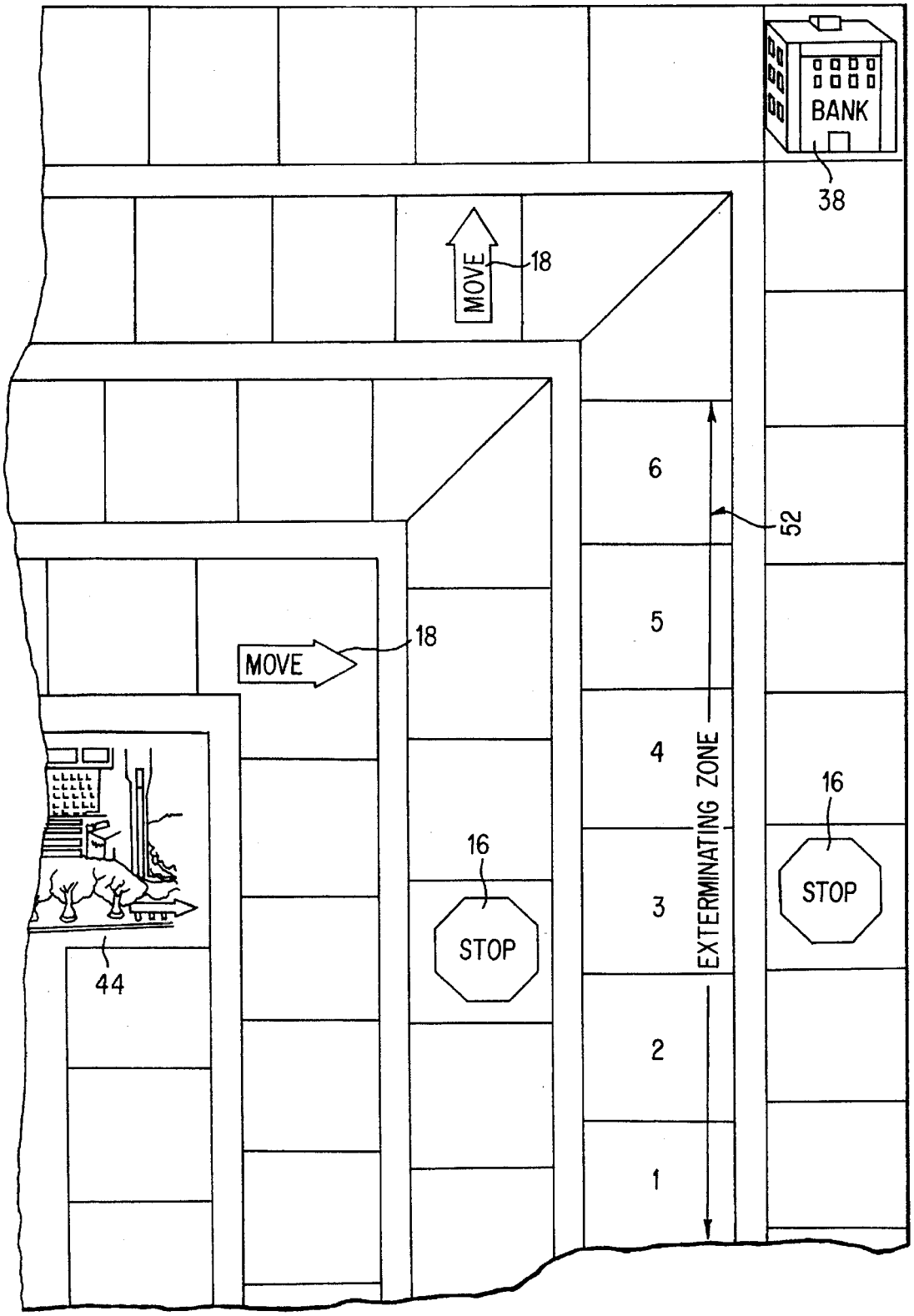
Figure 1D:
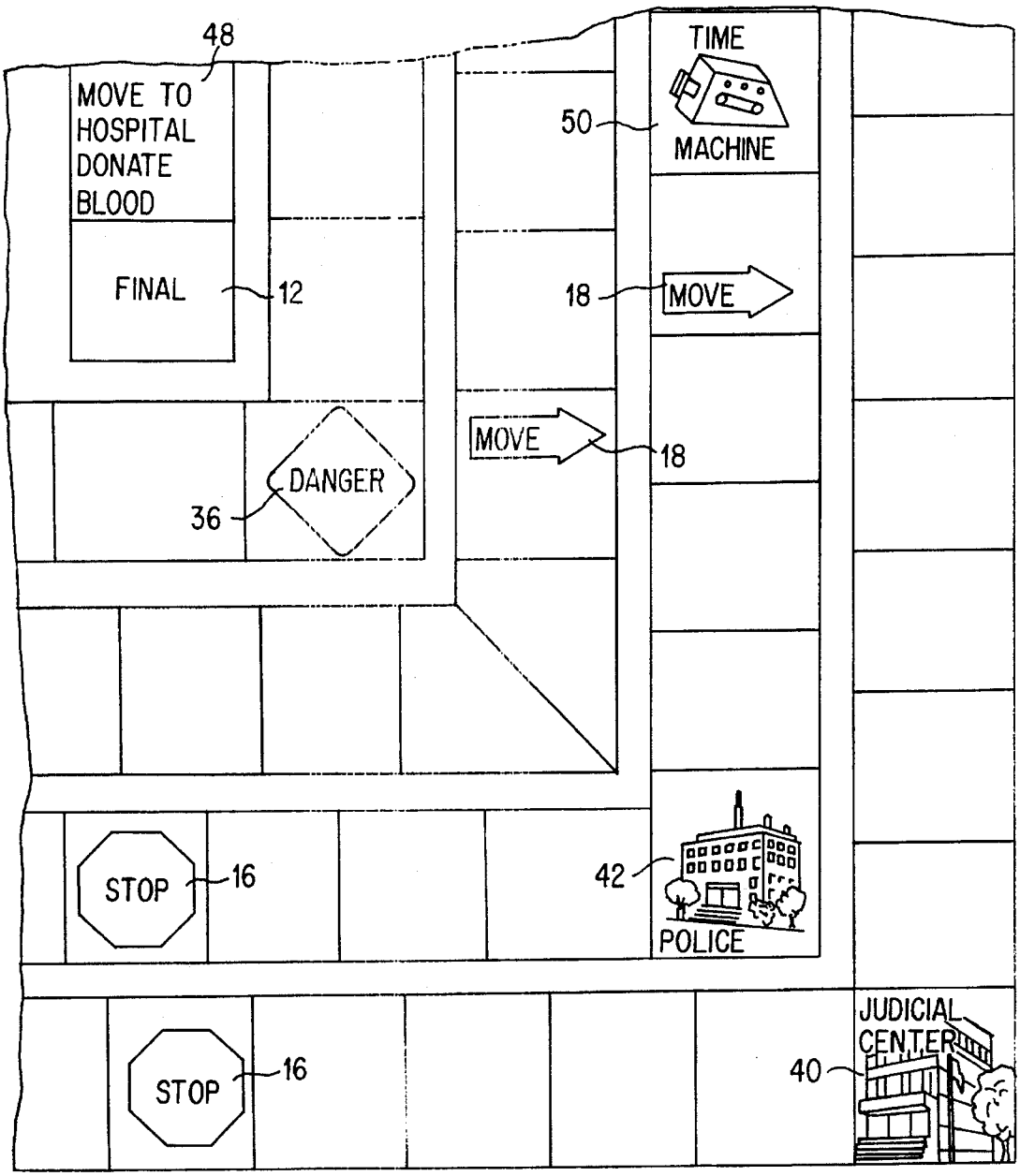

Referring now to FIGS. 1*a*–1*d* the numeral 10 refers to a start station, the numeral 12 to a final station (FIG. 1*d*) and the numeral 14 to a circuious path between the start and final stations and which is divided into a number of separate stations some of which are blank and some of which bear printed indicia instructing a player whose token lands on one of the latter upon the throw of a pair of dice 15*a*, 15*b* (FIG. 3), to perform certain acts. For example, a number of stations 16 have printed thereon "Stop" signs 16 such that when a selected one of a player's pair of identical tokens, say 17*a* or 17*b* as shown in FIG. 5, lands on a "Stop" sign station he loses a turn. Note that only one token say 17*a*, of each set is used to represent a player in his advance along the path. The function of the second token 17*b* of the set will be explained hereinafter. Though both tokens of each set must be identical, this can be by way of colors, shapes numbers or any other identical indicia on the two tokens of each set.

There are a number of stations 18 bearing the word "Move" inside an arrow. When a player lands on one of these he must follow the arrow to a blank station of an adjacent leg of the path which is invariably downstream of the player's present position on the path. There may be a number of other stations bearing other instructions such as, for example, a "School" zone sign as at 20 from which a player's advance may be restricted until he passes a station 22 illustrating a school.

Other stations 24 may be marked "Max Speed 3 mph". When a player lands on one of these he is required to throw one dice and if a number greater than three is thrown three times after three landings on a "Maximum Speed" station 24, the player goes directly to station 26 marked "Jail". If he again lands three times on a "Max Speed" station he again goes to jail and then receives a suspension in which only one die 15 can be used for the rest of the game. Should this happen three more times, the player is expelled from the game. The player keeps track of the number of times he has exceeded the speed limit by marking blocks 27 on a "Card of Fines" 28 shown in FIG. 4.

There may be a station 30 marked with a stop light requiring a player landing there to lose a specified number of turns. One or more stations 32 may require a player landing there to rethrow the dice and move in reverse. Yet another station 34 may be marked a "Prohibited Zone" and require a player to move his one token to the jail station 26 where certain conditions as explained below must be met before the player is free of jail. There may be a station 36 marked "Danger" requiring a player to perform some act as set forth in separate Rules of Play (not shown) such as returning to the "Start" station 10.

In accordance with the invention, in addition to the jail station 26 there are other public building stations, namely, a bank station 38, a judicial center 40, a police station 42, and a hospital 44.

Whenever a player's first token 17*a* is required to go to the jail station 26 it must remain there until a bail bondsman, represented by the player's other identical token 17*b*, travels from the judicial center 40 to the jail whereupon when the second token reaches or passes the jail, the player's first token may move in the regular way upon the player's next turn and the second token is removed from the board. Similarly, when a player's first token 17*a* lands on the bank station 38, the player is assumed to be wounded during a bank hold-up and his first token 17*a* must wait at the bank 38 until a physician, represented by his second token 17*b*, travels from the hospital 44 past the bank 38 whereupon the first token 17*a* may proceed on the path in the regular way and the second token 17*b* is removed from the board.

In accordance with the invention, there is a station 46 marked "Accident—Wait for Police". When a player's first token 17*a* lands on station 46, it must remain there until the player's other token 17*b*, now representing the police, travels from the police station 42 to the scene of the accident 46. The Rules of Play may require that the respective public servants represented by a player's second token travel at selected rates to their respective destinations. The Rules specify that upon landing on the "Accident" station 46 a certain number of times, a player is required to go to jail.

When a player's first token 17*a* lands on the Hospital station 44 the Rules of Play specify that the player is ill and must remain in the hospital for a specified number of plays. This number can be determined by the throw of a single die at the player's next turn. Should a player, enroute to the final station 12, land on the penultimate station 48 bearing instructions to "Donate Blood—Move to Hospital", the player's first token must be moved to the Hospital and remain there as he would if he had landed in the Hospital during regular play as explained immediately above.

In accordance with the invention a "Time Machine" station 50 is provided and when a player's first token 17*a* lands on this station, at his next turn he throws a single die and moves his token to that one of six successive stations collectively numbered 52 and labeled "Exterminating Zone", the six stations being individually numbered 1 to 6 corresponding to the numbers on a die. Thus a player upon landing on the Time Machine station 50, throwing the single die and moving his token to that station of the Exterminating Zone which corresponds to the die number, then subtracts that number from the current year, say 1994, previously written in a space 54 on the "Card of Fines" in one of a pair of vertical columns labeled at 56 "Time Machine". The resulting number is written in the space 58 beneath 1994, the player having previously written his "year of Birth" in the space 60 over those words. Should a player's token be required for any of various reasons to return to a position downstream of the "Time Machine" station 50 and subsequently land on that station he must continue to subtract from the "prior year" already entered below the current year, the number appearing on the single die and then write this in the next space 60, and so on for each landing on the Time Machine station. Should the final result be a year before the player was born he must drop out of the game on the grounds that he no longer exists.

The obstacles which a player may encounter can vary to some extent without departing from the scope and spirit of the appended claims.

What is claimed is:

1. A board game comprising a path leading from a start station to a final station, a series of intermediate stations between said start and final stations, a set of first and second tokens for each player, each set being different from every other set and both tokens of each set bearing identical distinguishing indicia, the first token of each set representing a player personally and the second token of each set representing a public servant, chance means actuated by a player for producing one number of a first predetermined range of numbers representing those stations over which a player's first token is to be advanced, some of said stations bearing directions affecting further movement of said first token upon landing thereon, other of said stations representing public buildings for occupation by respective public servants, yet other of said stations depicting scenes of respective events each requiring the presence of a relevant public servant before a first token can be advanced beyond said last mentioned station, said chance means being operable by said player to advance a respective public servant represented by a player's second token from an applicable public building appropriate to said event to or beyond the station indicating said event thereby enabling a player's first token to be advanced beyond said last mentioned station.

2. The board game of claim 1 wherein said chance means comprise a pair of dice.

3. The board game of claim 2 wherein one station of the path is marked "time machine", and the succeeding six stations are numbered one to six and labeled collectively "exterminating zone" for reception of a token following landing of a player's first token on said "time machine" station, subsequent throw of a single dice indicating to which of said stations numbered one to six said token should be moved.

4. The board game of claim 1 wherein said stations representing public buildings are a police station, a hospital and a judicial center and said public servants represented by a players second token are a policeman, a physician and a bail bondsman which are advanced from said respective public buildings to the stations of respective designated events appropriate to the respective public servants.

5. The board game of claim 4 wherein said events are incarceration in a station designated "jail" calling for the presence of said bail bondsman, an automobile accident calling for the presence of said policeman, and a bullet wounding calling for the presence of said physician.

* * * * *